US006029127A

United States Patent [19]

Delargy et al.

[11] Patent Number: 6,029,127

[45] Date of Patent: Feb. 22, 2000

[54] METHOD AND APPARATUS FOR COMPRESSING AUDIO SIGNALS

[75] Inventors: Jeffrey T. Delargy; Mark S. Kressin, both of Austin, Tex.

[73] Assignee: International Business Machines Corporation, Armonk, N.Y.

[21] Appl. No.: 08/827,550

[22] Filed: Mar. 28, 1997

[51] Int. Cl.[7] ..... G10L 9/00

[52] U.S. Cl. ..... 704/215; 704/210

[58] Field of Search ..... 704/500, 501, 704/502, 503, 200, 215, 210, 233, 201, 226

[56] References Cited

U.S. PATENT DOCUMENTS

| | | | |
|---|---|---|---|
| 4,130,739 | 12/1978 | Patten | 369/50 |
| 4,528,659 | 7/1985 | Jones, Jr. | 370/435 |
| 4,663,675 | 5/1987 | Jones, Jr. et al. | 360/32 |
| 5,392,223 | 2/1995 | Caci | 395/200 |
| 5,530,950 | 6/1996 | Medan et al. | 379/88.24 |
| 5,706,393 | 1/1998 | Ehara | 704/215 |
| 5,742,930 | 4/1998 | Howit | 704/502 |

*Primary Examiner*—Richemond Dorvil
*Attorney, Agent, or Firm*—George R. Schultz; Akin, Gump, et al.; Volel Emile

[57] ABSTRACT

An audio data compression method improves over existing standards because of its encoding strategy for silence. The method analyzes the audio input to an encoder. If the audio is for an analyzed time frame is silence, a single byte output is generated by the encoder. If the next frame is silence, no output is generated. When a receiver receives the compressed data, and detects a one-byte silence signal, it can capture that signal and repeat it to a decoder. When the compressed signal reaches the decoder, it is decompressed into an analog signal.

17 Claims, 2 Drawing Sheets

METHOD AND APPARATUS FOR COMPRESSING AUDIO SIGNALS

FIELD OF THE INVENTION

This invention relates to a method of reducing the amount of digital information needed to convey a silence signal in an audio compression scheme.

BACKGROUND OF THE INVENTION

Compression of digital data is essential to improve the capacity of digital transmission systems. Voice data presents particular challenges. When the speaker pauses, the silence between words is often encoded in the same way as active speech. This produces repetitive output which wastes available transmission bandwidth. This problem is especially keen during multi-party teleconferences when only one party is speaking while the others remain silent.

A commonly used audio compression algorithm is the G.723.1 standard promulgated by the International Telecommunication Union. This system is particularly geared for digital multimedia applications. This standard specifies the coding of audio to reduce the amount of digital information required to reproduce the original audio input. This standard has transmission rates of 5.3 kbits/second and 6.3 kbits/second. Audio is broken into 30 msec time frames. There is a look ahead of 7.5 msec, resulting in a total algorithmic delay of 37.5 msec. The coder is designed to operate with a digital signal obtained by first performing telephone bandwidth filtering of the analog input, then sampling at 8000 Hz and then converting to 16-bit linear PCM for the input to the encoder. The output of the decoder should be converted back to analog by similar means. The encoder operates on 240 samples per frame. Each frame is divided into four subframes of 60 samples each. For each frame containing speech, a twenty to twenty-four byte output is generated. Every frame containing the spectral characteristics of silence is represented by a four byte output. In other words, for a three second pause, 100 four byte data output is created. A need exists for a method of further compressing audio input, particularly silence. Such a method should improve upon the G.723.1 standard.

SUMMARY OF THE INVENTION

The present invention relates to an improvement over the G.723.1 standard for audio compression. The method analyzes the audio input to an encoder. The G.723.1 standard sets forth a special characteristic for silence. If the audio for an analyzed time frame is silence, a single byte output is generated by the encoder. If the next frame is silence, no output is generated. Thus, for example, a three second pause would only generate a single byte of output rather than potentially 100 four byte outputs. This is a substantial improvement over the existing standard.

When a receiver receives the compressed data, and detects a one-byte silence signal, it can capture that signal and repeat it to a decoder. In other words, rather than let the decoder sit idle during the duration of the silence, it will continue to receive the mimicked output. Thus, transmission bandwidth is not wasted. During the duration of the silence, no additional signal is generated. The additional data is being created downstream of the transmission medium by the receiver prior to decoding.

When the compressed signal reaches the decoder, it is decompressed into an analog signal. The analog signal is then used to drive a speaker. Again, a one byte signal will be decoded as a silence, while other compressed voice data will be decompressed to reproduce the speaker's words. Of course, the input can be any audio content, and is not limited to merely spoken words.

BRIEF DESCRIPTION OF THE DRAWINGS

The foreground aspects and other features of the present invention are explained in the following written description, taken in connection with the accompanying drawings, wherein.

DETAILED DESCRIPTION OF THE DRAWINGS

Audio compression seeks to replace repetitive portions in the audio input with simpler data. Silence is an excellent example of when audio compression can be effectively used without a loss of input information. As discussed above, the G.723.1 standard replaces frames of silence with a continuous string of four byte representations. The present invention improves on this standard by replacing frames of silence with a single output byte. This byte is the final output until speech is detected and regular encoding begins again.

Figure 1:
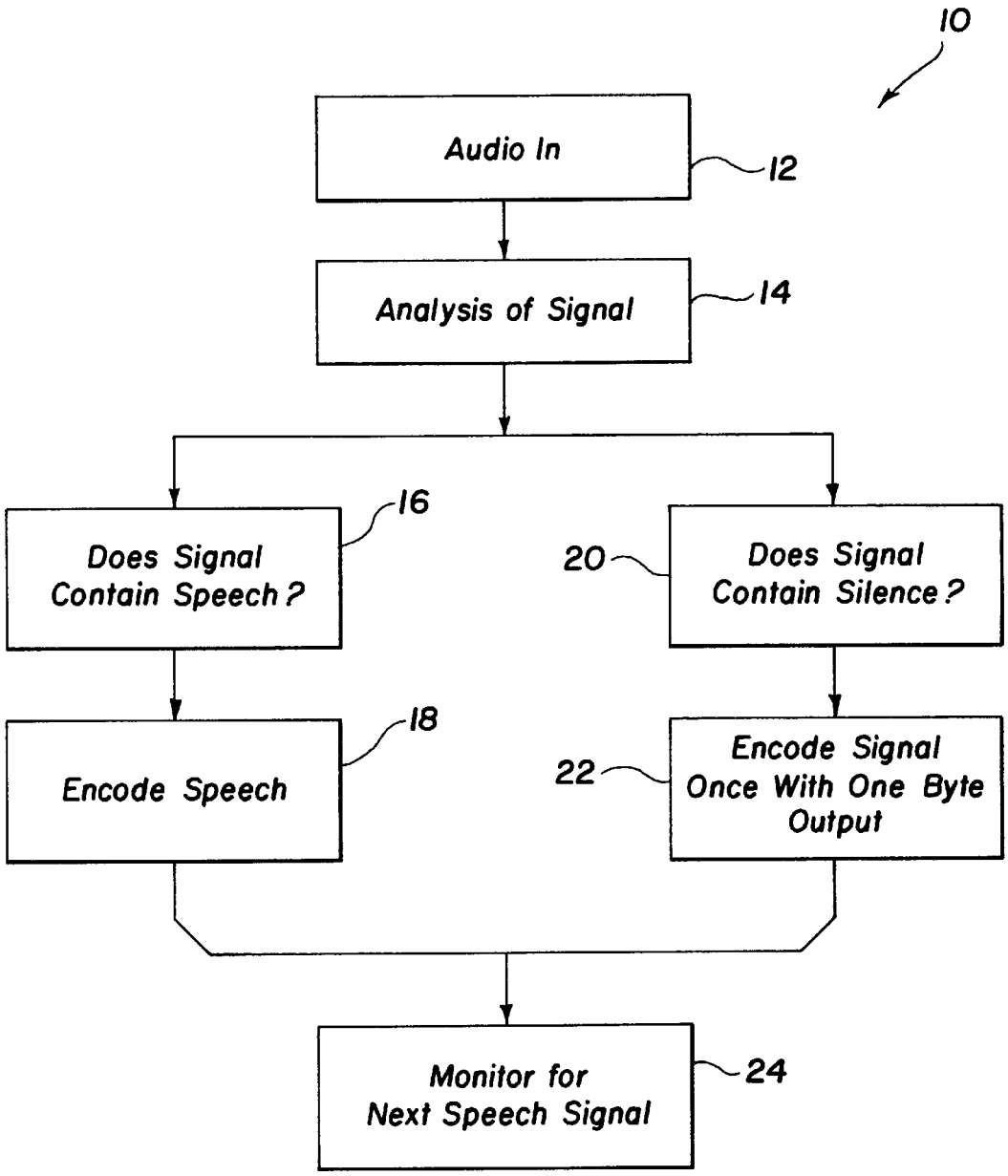
FIG. 1 is a flow chart of the basic encoding scheme according to the present invention.
Figure 2:
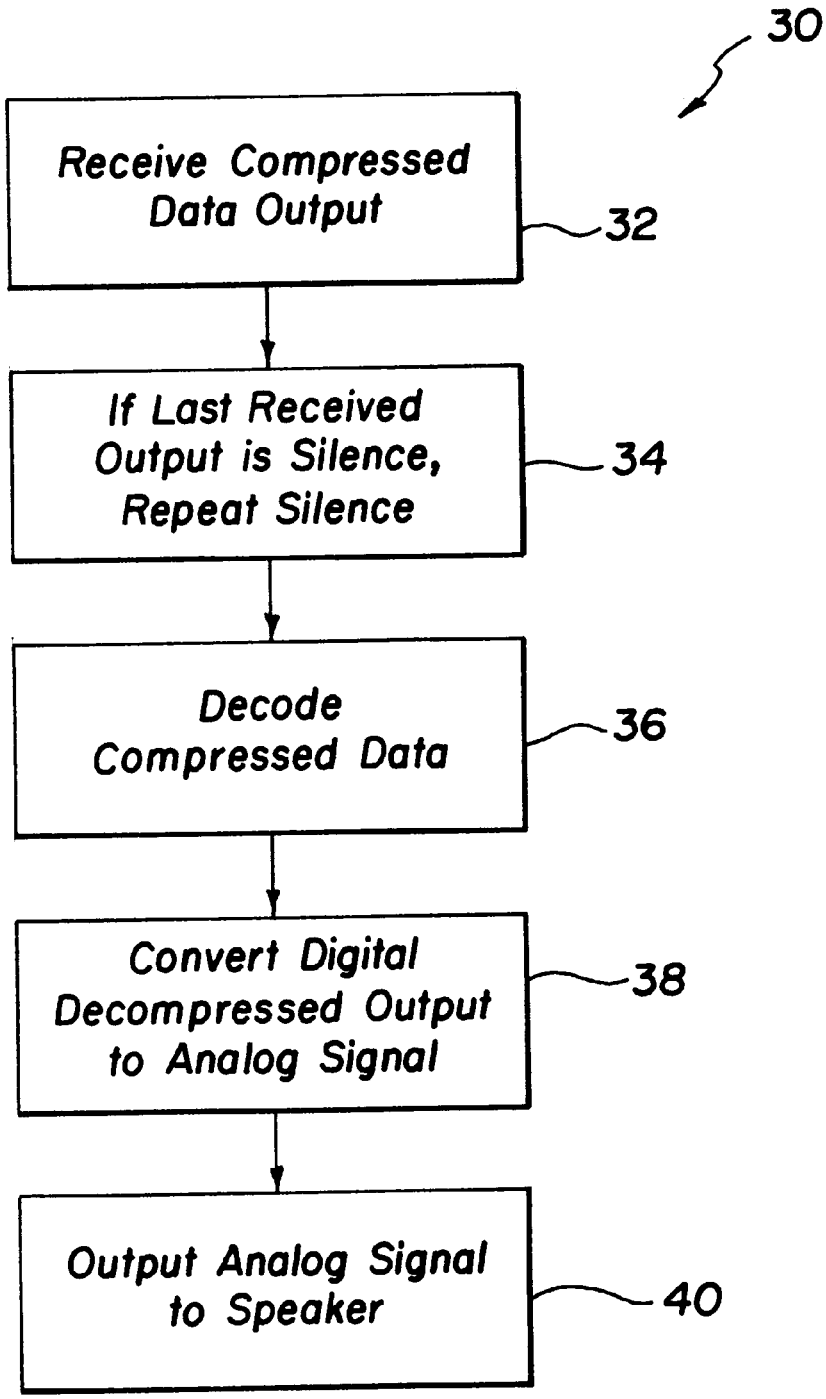
FIG. 2 is a flow chart of the decoding scheme of the present invention.

FIG. 1 is a flow chart 10 of the encoding scheme. Audio is input 12 into an encoder. The signal is analyzed 14 to determine if a frame of the audio contains speech or silence. The frame can be any duration. Under existing standards, the frame is typically 30 msec in duration. If the signal contains speech 16, then the signal will be encoded 18 as normal. This results in a twenty to twenty-four byte output under the G.723.1 standard.

Silence has its own spectral characteristics, which if detected will result in a four byte output under the existing standard. If the signal contains silence 20, the next encoded output will be a single byte representing the silence. If the next frame is silence, no output is generated. In one embodiment, the first frame of silence is encoded with the standard four byte representation, followed by a one byte representation, followed by no output. In another embodiment, the first frame of silence is encoded with a single byte output, with each following frame of silence generating no output. Whether the last frame contained silence or sound, the audio input is monitored for the next speech signal 24.

The compressed data from the encoder is then conveyed along a transmission means to a receiver. If the last signal received 32 is the one byte silence representation, then the receiver can repeat 34 that representation to the decoder. The decoder will continue to receive the receiver's output even though no compressed data is provided by the encoder during the duration of the silence. The decoder will decompress the data 36. The decompressed data can then be converted 38 into an analog signal by a digital to analog converter. The decompressed analog data can now be output 40 to a speaker or other suitable device.

It will be appreciated that the detailed disclosure has been presented by way of example only and is not intended to be limiting. Various alterations, modifications and improvements will readily occur to those skilled in the art and may be practiced without departing from the spirit and scope of the invention. The invention is limited only as required by the following claims and equivalents thereto.

We claim:

1. A method of audio compression comprising the steps of:

(a) monitoring an audio input;

(b) characterizing said audio input as silence and non-silence; and (c) outputting a single representative frame for said silence until non-silence is detected.

2. The method of claim 1 wherein the representative frame is a single byte.

3. The method of claim 1 further comprising:

(d) outputting no data between output of the representative frame and detection of non-silence.

4. The method of claim 1 wherein step (a) comprises:

(i) receiving an audio input at an encoder;

(ii) analyzing said input in a plurality of sequential time frames.

5. The method of claim 4 wherein the step of analyzing comprises analyzing 30 msec time frames of the audio input for the silence.

6. The method of claim 1 wherein step (b) comprises comparing the spectral characteristic of the analyzed audio input to a predetermined spectral characteristic.

7. The method of claim 1 further comprising:

(d) receiving the single representative frame;

(e) repeating the single representative frame to a decoder.

8. The method of claim 7 further comprising:

(f) decoding the single representative frame.

9. The method of claim 8 further comprises:

(g) outputting the decoded output to a speaker.

10. The method of claim 8 further comprises:

(g) outputting the decoded output to a speaker.

11. A method of encoding a silence in an audio compression scheme comprising:

(a) analyzing a time frame of audio input;

(b) comparing the spectral characteristics of the analyzed input to a predetermined spectral characteristic;

(c) classifying said time frame as silence and non-silence; and (d) encoding said silence with a single byte output until non-silence is detected.

12. The method of claim 10 wherein step (d) comprises:

(i) encoding a first time frame of silence with a four byte output;

(ii) encoding a second time frame of silence with a one byte output; and (iii) encoding a third time frame of silence with no data output.

13. The method of claim 10 further comprises:

(e) receiving the one byte output;

(f) repeating the one byte output to a decoder.

14. The method of claim 12 further comprises:

(g) decoding the received output.

15. An encoder for audio compression comprising:

(a) a detector for an audio input;

(b) means for characterizing said audio input as silence and non-silence; and (c) means for outputting a single representative frame for said silence.

16. The encoder of claim 15 wherein the representative frame is one byte.

17. the encoder of claim 15 further comprises:

(d) means for outputting no data between output of the representative frame and detection of non-silence.

* * * * *